United States Patent [19]

Tsuchiya

[11] Patent Number: 4,467,189

[45] Date of Patent: Aug. 21, 1984

[54] FRAMING TUBE AND FRAMING CAMERA

[75] Inventor: Yutaka Tsuchiya, Hamamatsu, Japan

[73] Assignee: Hamamatsu Photonics Kabushiki Kaisha, Hamamatsu, Japan

[21] Appl. No.: 308,172

[22] Filed: Oct. 2, 1981

[30] Foreign Application Priority Data

Oct. 14, 1980 [JP] Japan ..... 55-143984

[51] Int. Cl.[3] ..... H01J 31/50

[52] U.S. Cl. ..... 250/213 VT; 313/529

[58] Field of Search ..... 313/529, 537; 250/213 VT

[56] References Cited

U.S. PATENT DOCUMENTS 4,243,878 1/1981 Kalibjian ..... 250/213 VT 4,350,919 9/1982 Johnson et al. ..... 250/213 VT

*Primary Examiner*—F. L. Evans

*Attorney, Agent, or Firm*—Wenderoth, Lind & Ponack

[57] ABSTRACT

A framing tube includes a cylindrical airtight vacuum tube, a shutter plate, and a ramp generator. The container has a photocathode at one end thereof and a fluorescent screen at the other end thereof which is opposite to the photocathode. The shutter plate is disposed between and parallel to the surface of the photocathode and fluorescent screen and has a multiplicity of through holes perforated perpendicular to its surface. The shutter plate also carries at least three electrodes that are disposed perpendicular to the axis of the through holes and spaced parallel to each other. The electrodes divide the surface of the shutter plate into a plurality of sections. The ramp generator is connected to the electrodes. The ramp voltage generated changes in such a manner as to reverse its polarity, producing a time lag between the individual electrode. Developing an electric field across the axis of the through holes in the shutter screen, the ramp voltage controls the passage of the electron beams from the photocathode through the through holes. A framing camera includes the above-described framing tube and an optical system. The optical system includes a semitransparent mirror that breaks up the light from the object under observation into a plurality of light components and a focussing lens disposed in the path through which each of the light components travels. Each of the light components corresponds to each of the sections on the shutter plate. The images of a rapidly changing object are reproduced, at extremely short time intervals, on different parts of the fluorescent screen.

2 Claims, 14 Drawing Figures

FRAMING TUBE AND FRAMING CAMERA

BACKGROUND OF THE INVENTION

This invention relates to a framing tube that optically detects physical phenomenon changing at very high speed and a camera incorporating such a framing tube.

For instance, continuous images of a nuclear fusion phenomenon changing at very high speed, which occurs when a capsule of heavy hydrogen is explosively condensed with the laser beam, reproduced with high accuracy in terms of time can be a useful piece of data for the development of nuclear fusion reactors. This type of image reproducing calls for a very short exposure time and interval. The framing camera is a device used for such purpose, and the framing tube is a vacuum tube that constitutes the main part of the framing camera. Conventional framing cameras and tubes are complex in structure and operation, as described below. Besides, they cannot insure exact exposure time and interval.

FIG. 1 shows an example of conventional framing cameras. Reference numeral 1 designates a framing tube in cross section, which comprises a cylindrical airtight vacuum container 11 in which a photocathode 13 is provided on the inside of a first transparent end 12 thereof and a fine-mesh electrode 14 is disposed parallel and close to said photocathode. A fluorescent screen 18 is provided on the inside of a second transparent end 19 of the cylindrical airtight container 11, with deflecting electrodes 16 and 17 disposed, one above the other, in such a manner as to allow the passage of photoelectron beams from the fine-mesh electrode 14 to the fluorescent screen 18 therebetween. Reference numeral 15 designates a focusing electrode. The electric field due to the focusing electrode 15 focuses photoelectron beams from the photocathode 13, on the fluorescent screen 18 to form the optical image thereon, corresponding to the electronic image on the photocathode 13. A direct current power supply 24 holds the photocathode at a potential lower than that of the fluorescent screen 18. A direct current power supply 23 and a resistor 26 keep the fine-mesh electrode at a still lower potential. Accordingly, even when an optical image A is projected on the photocathode 13, its photoelectrons are cut off by the fine-mesh electrode 14. The photoelectrons pass through the fine-mesh electrode 14 only at a moment when a pulse power supply 20 applies a positive rectangular pulse as shown at I in FIG. 2 to the fine-mesh electrode 14 through a capacitor 25. During the time in which several such pulses are produced, a ramp generator 27 applies a ramp voltage that sweeps photoelectron beams from one end of the fluorescent screen 18 to the other end thereof, as shown at II in FIG. 2, to between the deflecting electrodes 16 and 17. Consequently, the optical image A is reproduced on the fluorescent screen 18 as a plurality of images $A_1$, $A_2$, $A_3$, and so on, varying at intervals at which the pulses are produced. Because of the technical difficulty in pulse generation, however, such a framing camera cannot provide an exposure time shorter than 10 nanoseconds. The exposure interval depends on the time required for deflecting the photoelectron beams so that the second image $A_2$ should not overlap the first image $A_1$. Namely, the exposure interval is determined by the rate at which the voltage supplied from the ramp generator 27 changes, the limit being 50 nanoseconds. A clearer image will be obtained if a stepped voltage which is constant when the pulse power supply 20 sends forth the rectangular pulse and which changes when it stops the pulse supply, as shown at III in FIG. 2, is applied between the deflecting electrodes 16 and 17 in place of the ramp voltage. A negative pulse may be applied on the photocathode 13 instead of applying the positive pulse on the fine-mesh electrode 14, but the limit on the exposure time and interval remains unchanged.

FIG. 3 shows another example of conventional framing cameras. Reference numeral 3 designates a framing tube in cross section, which comprises a cylindrical airtight vacuum container 31 in which a photocathode 33 is provided on the inside of a first transparent end 32 thereof and a fluorescent screen 40 on the inside of a second transparent end 41 thereof. Between the photocathode 33 and fluorescent screen 40 is provided a slit plate 37 which is parallel thereto, the slit plate 37 having a plurality of parallel slits 371 372 and 373. Between the photocathode 33 and slit plate 37 are disposed paired deflecting electrodes 35 and 36, one above the other, in such a manner as to allow the passage of photoelectrons therebetween. Deflecting electrodes 38 and 39 are disposed between the slit plate 37 and fluorescent screen 40 in a similar fashion. Element 34 is a focusing electrode. The electric field due to the focusing electrode 34 focuses photoelectron beams from the photocathode 33 on the fluorescent screen 40 to form the optical image thereon, corresponding to the electronic image on the photocathode 33. Since a direct current power supply 42 keeps the photocathode 33 at a potential lower than that of the slit plate 37, the photoelectrons released when an optical image B is projected on the photocathode 33 strike against the slit plate 37. If a ramp generator 48 then applies a ramp voltage across the deflecting electrodes 35 and 36, the electron beams are swept at right angles with the slits 371, 372 and 373, whereupon an image formed by the photoelectron beams passes, successively from one end thereof, through the slits 371, 372 and 373 at intervals that depend on the sweeping rate and slit intervals. The photoelectron beams having passed through the slits 371, 372 and 373 make up a plurality of optical images B changing between the time intervals dependent upon the sweeping rate and slit intervals and are arranged in a line in the order in which time passes. When the ramp generator 47 applies ramp voltages of opposite polarities to the deflecting electrodes 38 and 39, the time-lagged optical image B are reproduced on the fluorescent screen as a plurality of images $B_1$, $B_2$ and $B_3$. The image $B_1$, $B_2$ and $B_3$ obtained by this framing camera are not the reproduction of the different parts of the optical image B at one time, but those at different times. With a large portion of the photoelectron beams cut off by the slit plate 37, only a small portion thereof is utilized in reproducing the image on the fluorescent screen 40. With this type of framing camera, the exposure time and intervals are determined by the limit of speed with which the voltage produced by the ramp generators 47 and 48 changes. It is therefore difficult to obtain the exposure time which is not longer than the 100 picoseconds which is necessary for the electron beam image to cross the slit and the exposure interval of not longer than 50 nanoseconds which is necessary for the images $B_1$ and $B_2$ not to overlap each other on the fluorescent screen 40.

FIG. 4 shows a third example of conventional framing cameras. Reference numeral 5 designates a framing tube in cross section, which comprises a cylindrical airtight vacuum container 51 in which a photocathode 53 is provided on the inside of a first transparent end 52 thereof and a fluorescent screen 63 on the inside of a second transparent end 64 thereof. Between the photocathode 53 and fluorescent screen 63 are provided shutter electrodes 56 and 57, correcting electrodes 59 and 60, and shifting electrodes 61 and 62. A direct current power supply 68 is connected to the photocathode 53 and fluorescent screen 63 to keep the photocathode 53 at a potential lower than that of the fluorescent screen 63. When an optical image C is projected on the photocathode, a repetitive deflecting voltage generator 65 applies a wavy repetitive deflecting voltage as shown at IV in FIG. 5 to the shutter electrodes 56 and 57, thereby deflecting the electron beams from below to above. When a deflecting voltage having the same waveform as and opposite in phase to or slightly lagging behind the repetitive deflecting voltage applied to the shutter electrodes 56 and 57 is applied to the correcting electrodes 59 and 60, the electron beams pass through the space between the correcting electrodes 59 and 60 at certain moments of time. When a ramp generator 66 applies a ramp voltage as shown at V in FIG. 5, to the shifting electrodes 61 and 62 which thereby causes the electron beams to sweep across the fluorescent screen 63, the optical image C is reproduced on the fluorescent screen 63 as a plurality of images $C_1$, $C_2$ and $C_3$ that vary at intervals each of which equals ½ of the cycle in which the waveform of the repetitive voltage changes. In FIG. 4, reference numeral 54 denotes a focusing electrode, 55 an anode electrode, and 58 an aperture plate. The electric field due to the focusing electrode 54 focuses photoelectron beams from the photocathode 53 on the fluorescent screen 63 to form an optical image thereon corresponding to the electronic image on the photocathode 53. This kind of framing camera requires a repetitive deflecting voltage generator, in addition to the ramp generator. The exposure time, which depends upon the rate of change of the repetitive deflecting voltage, cannot be made shorter than 10 nanoseconds and the exposure intervals, which depends upon the cycle of the repetitive deflecting voltage, cannot be made shorter than 50 nanoseconds. In this example too, a clearer image will be obtained if a stepped voltage that is constant when the repetitive deflecting voltage is approximately 0 volts and changes at other times, as shown at VI in FIG. 5, is applied to the shifting electrodes 61 and 62 instead of the ramp voltage.

The deflecting voltage used for the three types of framing camera described above must change over an amplitude of more than several kilovolts and at a speed of approximately 1 volt per picoseconds. But it is technically very difficult to generate such a voltage that changes over such a wide amplitude and with such a high speed.

SUMMARY OF THE INVENTION

An object of this invention is to provide a framing tube that is capable, with its simple structure and operation, of ensuring higher speed shutter operation than prior art tubes and is capable of changing the exposure time and intervals with ease.

Another object of this invention is to provide a framing camera that is capable of easily changing the exposure intervals in a very short time.

A framing tube according to this invention comprises a cylindrical airtight vacuum container, a shutter plate and a ramp generator. The container carries a photocathode at one end thereof and a fluorescent screen at the other in such a manner as to face each other. The shutter plate, having many through holes perforated perpendicular to the surface thereof, is disposed between, and parallel to the surface of, the photocathode and fluorescent screen. The shutter plate also carries at least three paralleled electrodes extending perpendicular to the axis of the through holes and spaced away from each other. These electrodes divide the surface of the shutter plate into a plurality of sections. The ramp generator is connected to the electrodes. The ramp voltage changes in such a manner as to reverse the polarity and lags from one electrode to another. By developing an electric field across the through holes in the shutter plate, the ramp voltage controls the passage therethrough of the electron beams released from the photocathode.

In this framing tube, the electron beams passed through the fine through holes are deflected by means of the electric field developed by the ramp voltage in the shutter plate. When the electric field is strong or the ramp voltage is high, the electron beams strike against the walls of the through holes, getting absorbed thereby. When the electric field is weak, the electron beams pass through the through holes. By changing the ramp voltage only by a small extent, therefore, the passage of the electron beams through the through holes can be controlled, and a high shutter speed obtained.

The shutter plate is divided into sections by the electrodes, to which the lagged ramp voltage is applied. On the fluorescent screen are formed a plurality of optical images, lagging each other and, corresponding to the sections on the shutter plate. Since a slight change in the ramp voltage can control the passage of the electron beams through the through holes, the plurality of optical images can be reproduced at extremely short intervals.

A framing camera according to this invention comprises a framing tube described above and an optical system to focus the image of an object to be observed on the photocathode. The optical system comprises a semi-transparent mirror that divides the light from the object into a plurality of light rays corresponding to the divided sections on the shutter plate and a focusing lens disposed in each of the paths along which the divided light rays travel.

Incorporating the framing tube of the above-described type, the framing camera of this invention is capable of reproducing the images of a rapidly changing phenomenon on different parts of the fluorescent screen at very short intervals.

DETAILED DESCRIPTION OF THE PREFERRED EMBODIMENTS

Referring now to FIGS. 6 through 14, preferred embodiments of this invention will be described.

Figure 6:
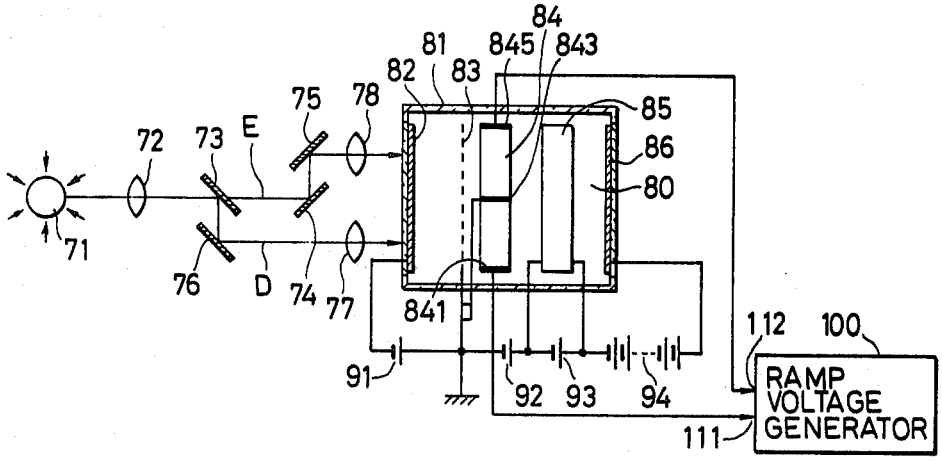
FIG. 6 shows a framing camera which is an embodiment of this invention.

FIG. 6 shows a framing camera which is an embodiment of this invention. Reference numeral 71 designates an object to be observed that changes at high speed. Lenses 72, 77 and 78 and mirrors 73, 74, 75 and 76 make up an optical system that breaks up an image of the object 71 into two and projects, over the same distance, the separated images on different parts of a photocathode 82 in a framing tube 80 to be described at length. The lens 72 is a relay lens, and the lenses 77 and 78 are focusing lense. The mirror 73 is a semitransparent beam splitter, and the mirrors 74, 75 and 76 are reflectors. Here, breaking up an image into two does not mean dividing an image into two geometrically different parts, but producing two identical optical images. Lines D and E indicate the paths along which light travels from the object 71 to the optical image thereof formed on the photocathode 82 in the framing tube 80 to be described later. The framing tube 80 comprises a cylindrical airtight vacuum container 81 with closed ends, provided with the photocathode 82 on the inside of a first end thereof and a fluorescent screen 86 on the inside of a second end thereof. Between the photocathode 82 and fluorescent screen 86 are disposed a fine-mesh electrode 83, a shutter plate 84 and a micro-channel plate 85 in that order. The fine-mesh electrode 83 uniformly accelerates the photoelectrons released from the photocathode 82 in the direction of the shutter plate 84 against the potential gradient that runs along the surface of the shutter plate 84 or at right angles with the axis of the framing tube 80.

Figure 1:
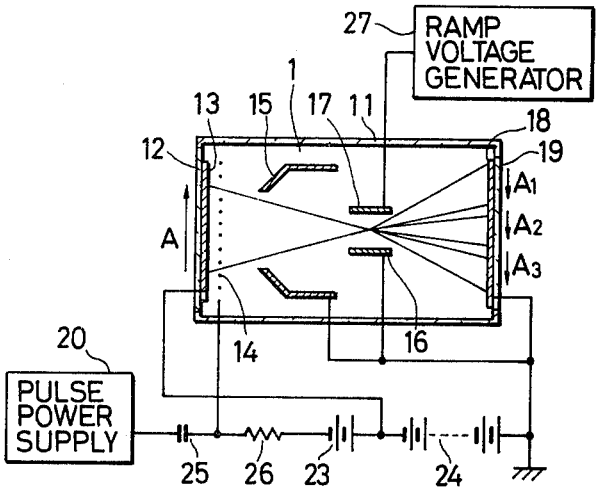
FIG. 1 PRIOR ART
FIG. 1 is a schematic cross section showing an example of conventional framing cameras.
Figure 2:
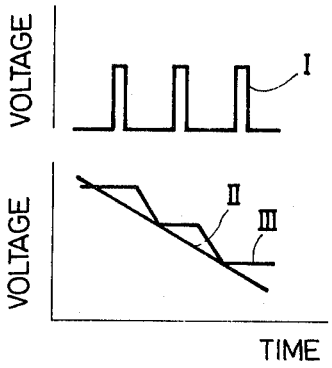
FIG. 2 PRIOR ART
FIG. 2 graphically shows the waveforms of the voltage used in the framing camera of FIG. 1.
Figure 3:
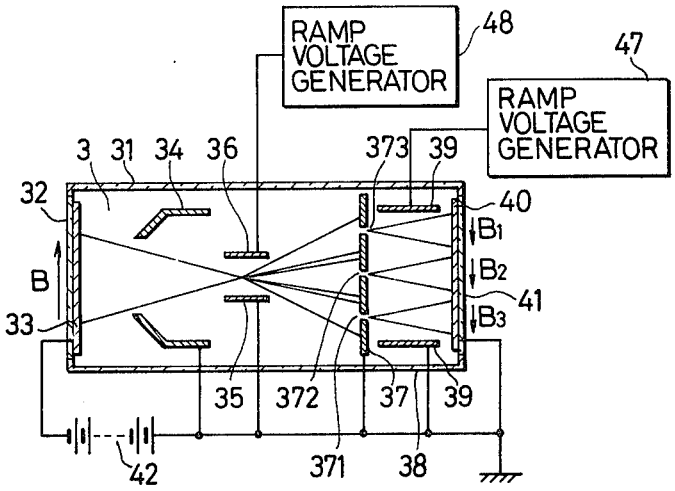
FIG. 3 PRIOR ART
FIG. 3 is a schematic cross section showing another example of conventional framing cameras.
Figure 4:
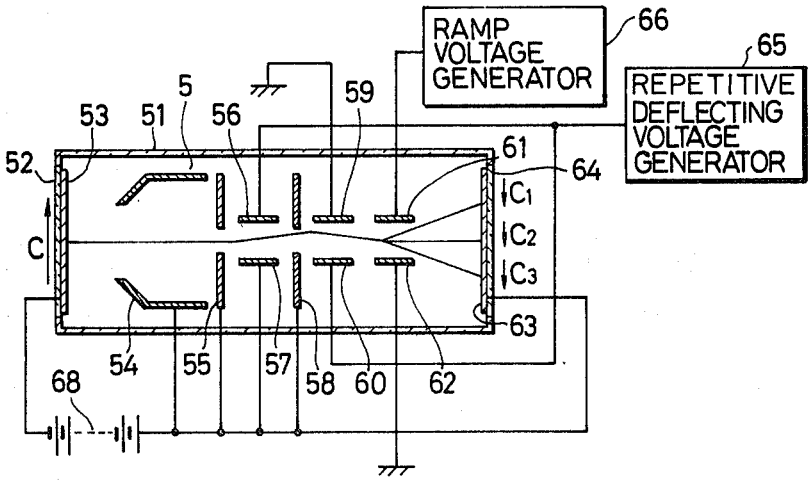
FIG. 4 PRIOR ART
FIG. 4 is a schematic cross section showing a third example of conventional framing cameras.
Figure 5:
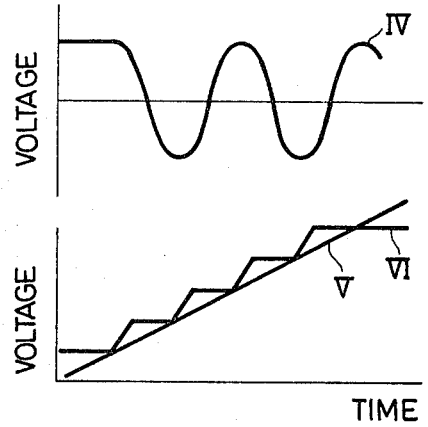
FIG. 5 PRIOR ART
FIG. 5 is graphically shows the waveforms of the voltage used in the framing camera of FIG. 4.
Figure 7:
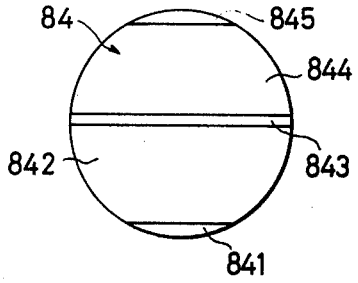
FIG. 7 is a front view of a shutter plate provided in the framing camera of FIG. 6.

Referring now to a front view in FIG. 7, the shutter plate 84 comprises a plate of such substance as has a suitable electric resistivity, perforated with a large number of through holes that are several tens of microns in diameter and extend perpendicular to the surface thereof. Spaced layers of a conductive material are provided thereon as electrodes 841, 843 and 845, with the spaces left therebetween constituting paths 842 and 844 along which electron beams travel.

Figure 8:
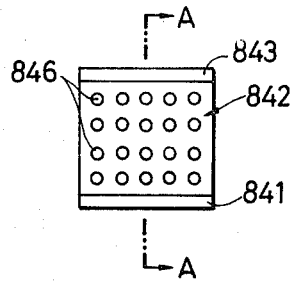
FIG. 8 is a front view schematically enlarging part of the shutter plate shown in FIG. 7.
Figure 9:
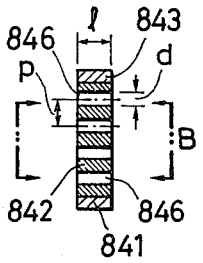
FIG. 9 is a cross section taken along the line A—A in FIG. 8.
Figure 10:
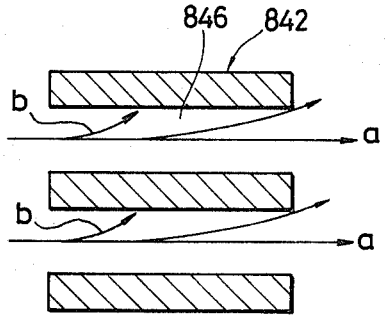
FIG. 10 is an enlargement of part B in FIG. 9, showing the track of electron beams.
Figure 11:
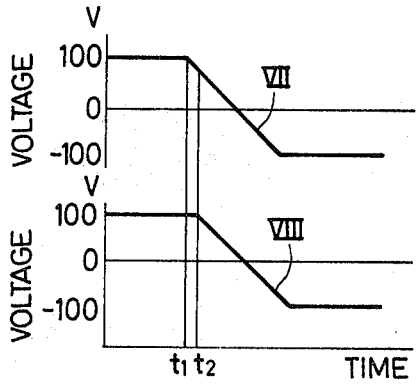
FIG. 11 graphically shows the waveforms of the voltage used in the framing camera of FIG. 6.

FIGS. 8 and 9 are schematic illustrations enlarging part of the shutter plate 84. FIG. 10 enlarges part B in FIG. 9. As shown, a large number of through holes 846 are provided across the path 842 as regularly, or with as uniform a density, as possible. All through holes 846 have substantially the same inside diameter. Since one square centimeter of the shutter plate 84 contains, for example, approximately one million through holes 846, each through hole 846 is extremely small compared with the size of the shutter plate 84. The shutter plate 84 is made of a bundle of fiberglass or an electrically insulating ceramic. The thickness (l) of the shutter plate 84 ranges between approximately 1 mm and 10 mm and the inside diameter (d) of the through holes 846 between approximately 10 μm and 500 μm, the pitches or intervals at which the through holes 846 are spaced being slightly larger than the inside diameter thereof.

The electrodes 841, 843 and 845 provided on the shutter plate 84 are parallel to each other, with a ramp generating circuit 100 being connected to the electrodes 841 and 845. The ramp generating circuit 100 develops an electric field, which runs across the through holes 846, between the electrodes 841 and 843 and between the electrodes 843 and 845.

The photoelectron beams which enter the path 842, parallel to the through holes, can pass therethrough, as indicated by the track a in FIG. 10, when the voltage between the electrodes 841 and 843 on the shutter plate 84 is zero or low enough. But when the voltage is higher, the photoelectron beams strike against the walls of the through holes and get absorbed thereby, as indicated by the track b. Accordingly, if a ramp voltage whose polarity reverses from time to time is applied between the electrodes 841 and 843, the photoelectron beams are allowed to pass through the through holes only during a very short period of time preceding and following the moment at which the voltage becomes zero. Then the path 842 functions as a shutter to check and pass the photoelectron beams, and the path 844 also functions similarly.

Figure 12:
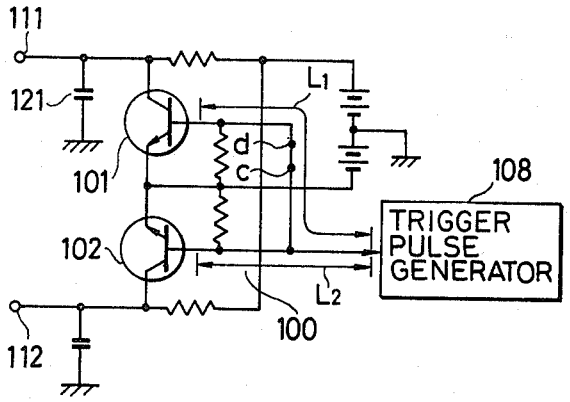
FIG. 12 is a circuit diagram of a ramp generator designated by reference numeral 100 in FIG. 6.
Figure 13:
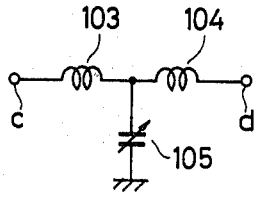
FIG. 13 diagrammatically shows a delay circuit that is inserted, when necessary, in the ramp generator of FIG. 12.
Figure 14:
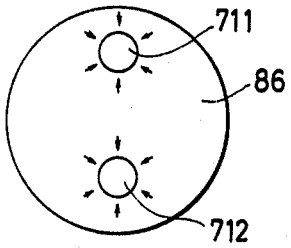
FIG. 14 shows the images of the object under observation reproduced in the fluorescent screen in the framing camera of FIG. 6.

Element 85 is a flat electron multiplier known as a micro-channel plate, which is provided with through holes that extend perpendicular to, or at an angle of a few degrees with, the surface thereof. The internal walls of the through holes have the ability to release secondary electrons; i.e. when voltage is applied across the two surfaces of the plate, the high-potential side releases the electrons coming in from the low-potential side, after multiplying their number. A direct current power supply 91 keeps the fine-mesh electrode 83 and the electrode 843 at the center of the shutter plate 84 at a potential 1 kilovolt higher than that of the photocathode 82. A direct current power supply 92 keeps that surface of the micro-channel plate 85 which faces the shutter plate 84 at a potential 1 kilovolt higher than that of the fine-mesh electrode 83. A direct current power supply 93 keeps the surface of the micro-channel plate 85 facing the fluorescent screen at a potential 800 volts higher than that of the surface facing the shutter plate 84. A direct current power supply 94 keeps the fluorescent screen 86 at a potential 3 kilovolts higher than that of the opposite surface of the micro-channel plate 85. The polarity-reversing ramp voltage, shown at VII in FIG. 11, applied from the output terminal 111 of a ramp generator 100 causes the potential of the electrode 841 on the shutter plate 84 to vary from 100 volts to −100 volts. Namely, the ramp voltage need not have greater amplitude than 200 volts, so that the desired rapidly changing ramp voltage can be obtained by discharging a capacitor 121 by means of a switching transistor 101, as shown in FIG. 12, that is brought into conduction by the trigger pulse released from a trigger pulse generator 108. This permits attaining a very short exposure time. If the ramp voltage changes at a rate of 5 volts per picosecond, the incoming electrons have an energy of 1 kilovolt, the through holes have a diameter of 25 microns and a length of 5 millimeters, and the space between the electrodes 841 and 843 is 10 millimeters, an exposure time of 16 picoseconds is obtained. The shuttering operation is achieved by applying the same ramp voltage as described above from the output terminal 112 of the ramp generator 100 to the electrode 845 on the shutter plate 84. By making the length $L_2$ of the transmission line between the trigger pulse generator 108 and the base of the switching transistor 102 greater than the length $L_1$ between the trigger pulse generator 108 and the base of the switching transistor 101, all shown in FIG. 12, the desired delay can be attained. By making $L_2$ 20 millimeters longer than $L_1$, for example, a delay of approximately 100 picoseconds results. Furthermore, the delay time can be adjusted by inserting a T-shaped circuit network, which comprises a variable capacitor 105 connected, in parallel, to a junction between series-connected inductances 103 and 104 as shown in FIG. 13, between, for example, c and d in the transmission line and changing the capacity of the variable capacitor 105. The waveform of the voltage thus applied on the electrode 841 on the shutter plate 84 and that on the electrode 845 are shown in VII and VIII in FIG. 11, against the common abscissa representing time.

In the above-described framing camera, the trigger pulse generator 108 generates pulses independently. But it is possible to achieve a framing reproduction synchronized with a change in the object 71 by use of the pulses generated by a pin-photodiode that detects the light emitted by the object 71 through a path shorter than the path through which the optical image of the object 71 is projected on the photocathode 82. The two light paths E and D between the object 71 and photocathode 82 in FIG. 6, which were previously described as having the same length, may be different in length. This difference can be compensated for by adjusting the length of the transmission lines from the trigger pulse generator 108 to the bases of the transistors 101 and 102.

In the framing camera described above, the image of the object 71 is broken up into a component that passes through the semitransparent beam splitter 7 and a component reflected thereby, after passing through the relay lens 72. After being reflected by the mirrors 74 and 75, the former is focused on that part of the photocathode 82 which faces the path 842 on the shutter plate 84. Meanwhile, the latter is focused, via the reflecting mirror 76, on that part of the photocathode which faces the path 844 on the shutter path 84. Then, the two optical images thus formed are converted into photoelectron beams, which, after being accelerated by the fine-mesh electrode 83, strike the paths 842 and 844 on the shutter plate 84. Since a voltage of 100 volts is applied across the surface of the shutter plate 84, the photoelectron beams cannot pass through the paths on the shutter plate 84, being absorbed by the walls of the through holes. With the ramp voltages VII and VIII, shown in FIG. 11, and respectively supplied to the electrodes 841 and 845, the electron beams are allowed to pass only during a period of 16 picoseconds when the absolute value of the applied voltages drop below 40 volts. By generating the ramp voltages VII and VIII at 100-picosecond intervals, according to the difference in the length of the transmission lines as mentioned before images 711 and 712 of the object 71, with a lag of 100 picoseconds therebetween, are reproduced on the fluorescent screen 86. By changing the capacity of the variable capacitor 105, the time lag between the two images 711 and 712 can be varied.

The embodiment described above has two paths for electron beams. But, evidently, this invention holds good with more paths, as well. In such cases, the image of the object must be broken up into a greater number of images, using more reflecting mirrors, to reproduced as many images, with appropriate time lags therebetween, as the number of electron beam paths.

If the use of the framing camera is confined to the determination of a change in the intensity of light emitted by the object, the focusing lens may be omitted.

What is claimed is:

1. A framing tube which comprises:

a cylindrical airtight vacuum container, the container being provided with a photocathode at one end thereof and a fluorescent screen at the other end thereof in such a manner as to face said photocathode;

a shutter plate disposed between and parallel to the surface of the photocathode and fluorescent screen in said container, the shutter plate having a multiplicity of through holes perforated perpendicular to the surface thereof and at least three electrodes disposed at right angles with the axis of the through holes and spaced parallel to each other, the electrodes dividing the surface of the shutter plate into a plurality of sections; and a polarity reversing ramp generator connected to said electrodes to supply lagging ramp voltage to each of the electrodes, the ramp voltage developing an electric field across the axis of the through holes in the shutter plate and thereby controlling the passage of the electron beams from the photocathode through the through holes.

2. A framing camera which comprises:

an optical system comprising a semitransparent mirror to break up the light from the object under observation into a plurality of light components and a focusing lens disposed in the path through which each of the light components travels;

a cylindrical airtight vacuum container, the container being provided with a photocathode on which said optical system projects a plurality of images of the object at one end thereof and a fluorescent screen at the other end thereof in such a manner as to face said photocathode;

a shutter plate disposed between and parallel to the surface of the photocathode and fluorescent screen in said container, the shutter plate having a multiplicity of through holes perforated perpendicular to the surface thereof and at least three electrodes disposed at right angles with the axis of the through holes and spaced parallel to each other, the electrodes dividing the surface of the shutter plate into a plurality of sections, each section corresponding to one of the plurality of images; and a polarity reversing ramp generator connected to said electrodes to supply lagging ramp voltage to each of the electrodes, the ramp volage developing an electric field across the axis of the through holes in the shutter plate and thereby controlling the passage of the electron beams from the photocathode through the through holes.

* * * * *